US007007735B1

(12) United States Patent
Lake

(10) Patent No.: US 7,007,735 B1
(45) Date of Patent: Mar. 7, 2006

(54) REMOVABLE AND ADJUSTABLE SCREEN

(76) Inventor: Terrence S. Lake, 1060 Goyeau #603, Windsor, ON (CA) N9A 6Y3

( * ) Notice: Subject to any disclaimer, the term of this patent is extended or adjusted under 35 U.S.C. 154(b) by 0 days.

(21) Appl. No.: 10/828,866

(22) Filed: Apr. 21, 2004

(51) Int. Cl.
*A47G 5/00* (2006.01)

(52) U.S. Cl. ..... 160/374.1; 160/381

(58) Field of Classification Search ..... 160/374.1, 160/381, 377, 376, 371, 369, 372, 373, 374, 160/375, 405
See application file for complete search history.

(56) References Cited

U.S. PATENT DOCUMENTS 690,662 A * 1/1902 Perrin ..... 160/353
794,469 A * 7/1905 Sherwood ..... 160/353
1,074,153 A * 9/1913 Zimmerman ..... 160/374
1,735,501 A * 11/1929 Hammill ..... 160/374
1,825,538 A * 9/1931 Pace ..... 160/105
2,596,438 A * 5/1952 Rollings ..... 160/369
2,814,078 A * 11/1957 Durr ..... 52/204.56
3,661,195 A * 5/1972 Fischer ..... 160/373
3,704,563 A * 12/1972 Waller ..... 52/455
4,050,498 A * 9/1977 Lucchetti ..... 160/374.1
4,127,156 A * 11/1978 Brandt ..... 160/179
4,301,853 A * 11/1981 Vidal ..... 160/374.1
4,565,020 A * 1/1986 Beatriz et al. ..... 38/102.5

* cited by examiner

*Primary Examiner*—David Purol

(57) ABSTRACT

A removable device has a screen, two stiles and two rails, connected by elbows. The rectangular screen admits light and air. The two stiles stand mutually parallel, rigid, and perpendicular to the horizon upon installation of the device in an opening. The two rails lie mutually parallel, rigid, and parallel to the horizon. The first elbows receive the rail coaxial with a first spring and the stile coaxial with a second spring while having gripping means. Slightly different, the second elbows have an adjusting means. The stiles and the rails connect to the elbows around the perimeter of the screen.

13 Claims, 3 Drawing Sheets

REMOVABLE AND ADJUSTABLE SCREEN

BACKGROUND OF THE INVENTION

1. Field of the Invention

The present invention relates to a removable and adjustable screen for use in connection with blocking creatures while admitting light and air. The removable and adjustable screen has particular utility in connection with fitting various sized openings.

2. Description of the Prior Art

Removable and adjustable screens are desirable for excluding birds and insects from openings while admitting light and air. Buildings have openings such as windows and balconies. Without a screen, those windows and balconies have little use during periods of insect prevalence. Insect prevalence coincides with warmer temperatures when people enjoy the out of doors. During warmer weather, a screen installed in an opening permits people to open windows and to use balconies without worry of insects. In some cases, screens remain permanent fixtures for openings. On occasion, a person may desire to remove a screen for cleaning or for enhanced visibility. In addition, a person may not desire to have a permanent screen due to landlord or zoning requirements.

The use of detachable screens is known in the prior art. For example, U.S. Pat. No. 3,763,917 to Antinone discloses a detachable screen. However, the Antinone '917 patent does not have a rigid frame, and has further drawbacks of joining to a building and lacking an adjusting mechanism.

U.S. Pat. No. 5,046,546 to Benedyk et al. discloses a screen enclosure apparatus that releases its screen during a high wind event. However, the Benedyk '546 patent does not use clips to retain the screen, and additionally does not have springs to position a frame within an opening.

Similarly, U.S. Pat. No. Des. 402,376 to St. Gelais et al. discloses a panel for a gazebo that has a divided panel. However, the St. Gelais '376 patent does not have an adjustable frame, and cannot secure to a structure with springs.

Similarly, U.S. Pat. No. 6,026,886 to Diamond-Martinez discloses a window covering that attaches behind garage door windows. However, the Martinez '886 patent does not have an integral frame, and cannot adjust its size.

Similarly, U.S. Pat. No. 5,271,449 to Herrick discloses a detachable barrier for a doorway that attaches to a doorframe by Velcro™. However, the Herrick '449 patent does not have a rigid frame, and cannot attach without a hook strip mounted to a doorframe.

Lastly, U.S. Pat. No. 4,712,598 to Bonacci et al. discloses a screen door assembly that folds accordion like for storage. However, the Bonacci '598 patent does not have a one-piece screen, and has the additional deficiency of no rigid frame.

While the above-described devices fulfill their respective, particular objectives and requirements, the aforementioned patents do not describe a removable and adjustable screen that allows fitting various sized openings. The Antinone '917 patent makes no provision for an adjustable frame. The Benedyk '546 patent lacks springs to position a frame. While the St. Gelais '376 and Martinez '886 patents lack an adjustable frame. The Herrick '449 patent requires a hook strip mounted to a doorframe to support a screen. Lastly, the Bonacci '598 patent makes no provision for a single screen in its accordion-folding screens.

Therefore, a need exists for a new and improved removable and adjustable screen that can be used for fitting various sized openings. In this regard, the present invention substantially fulfills this need. In this respect, the removable and adjustable screen according to the present invention substantially departs from the conventional concepts and designs of the prior art, and in doing so provides an apparatus primarily developed for the purpose of fitting various sized openings.

SUMMARY OF THE INVENTION

In view of the foregoing disadvantages inherent in the known types of detachable screens now present in the prior art, the present invention provides an improved removable and adjustable screen, and overcomes the above-mentioned disadvantages and drawbacks of the prior art. As such, the general purpose of the present invention, which will be described subsequently in greater detail, is to provide a new and improved removable and adjustable screen and method which has all the advantages of the prior art mentioned heretofore and many novel features that result in a removable and adjustable screen which is not anticipated, rendered obvious, suggested, or even implied by the prior art, either alone or in any combination thereof.

To attain this, the present invention essentially comprises a removable device to exclude insects and creatures that has a screen, two stiles and two rails, connected by first elbows and second elbows. The screen has a generally rectangular shape and permits passage of light and air. The two stiles stand mutually parallel and rigid and have sufficient length to span the height of an opening. The stiles have a location upon the perimeter of the screen and an orientation perpendicular to the horizon upon installation of the device in an opening. The two rails lie mutually parallel and rigid and have sufficient length to span the width of an opening. The rails have a location upon the perimeter of the screen and an orientation parallel to the horizon upon installation of the device in an opening. As a connecting part, the first elbows have a generally L shape, a hollow first end to receive the rail and a first spring, a hollow second end perpendicular to the first end to receive the stile and a second spring, and gripping means upon the first end on the same plane as the second end. Slightly different, the second elbows have a generally L shape, a hollow first end to receive the rail and a first spring, a hollow second end perpendicular to the first end to receive the stile and a second spring. Optionally, an adjusting means upon the first end on the same plane as the second end may also be included. The stiles and the rails connect to the first elbows and the second elbows around the perimeter of the screen with the gripping means on the same plane as the adjusting means.

An optional gripping means secures the screen to the rails, stiles, and elbows with clips in cooperation with a groove. Meanwhile, the adjusting means provides tension to the screen on two axes in various sized openings. There has thus been outlined, rather broadly, the more important features of the invention in order that the detailed description thereof that follows may be better understood and in order that the present contribution to the art may be better appreciated.

The invention may also include a first spring with an extended free end, a second spring with a cabined free end, feet on the elbows, thumbscrews in cooperation with holes to secure the stiles and the rails with elbows, snuggly fitting cross sections of stiles, rails, and elbows, and parallel-toothed plates for the adjusting means. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved removable and adjustable screen that has all of the advantages of the prior art detachable screens and none of the disadvantages.

It is another object of the present invention to provide a new and improved removable and adjustable screen that may be easily and efficiently manufactured and marketed.

An even further object of the present invention is to provide a new and improved removable and adjustable screen that has a low cost of manufacture with regard to both materials and labor, and which accordingly is then susceptible of low prices of sale to the consuming public, thereby making such removable and adjustable screen economically available to the buying public.

Still another object of the present invention is to provide a new removable and adjustable screen that provides in the apparatuses and methods of the prior art some of the advantages thereof, while simultaneously overcoming some of the disadvantages normally associated therewith.

Even still another object of the present invention is to provide a removable and adjustable screen for fitting various sized openings. This allows opening of windows and sitting upon balconies without insects.

Still yet another object of the present invention is to provide a removable and adjustable screen for fitting various sized openings. This makes it possible to fit the screen within various sized openings.

Still yet another object of the present invention is to provide a removable and adjustable screen for fitting various sized openings. This makes it possible to install a screen without permanent fixtures to a building.

Lastly, it is an object of the present invention to provide a new and improved method of excluding creatures from an opening with the following steps: 1) measuring the opening; 2) cutting rails and stiles to fit the opening; 3) inserting rails and stiles into spring loaded elbows; 4) securing a screen to the rectangle formed by the assembled rails and stiles; and, 5) positioning the screen within the opening.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
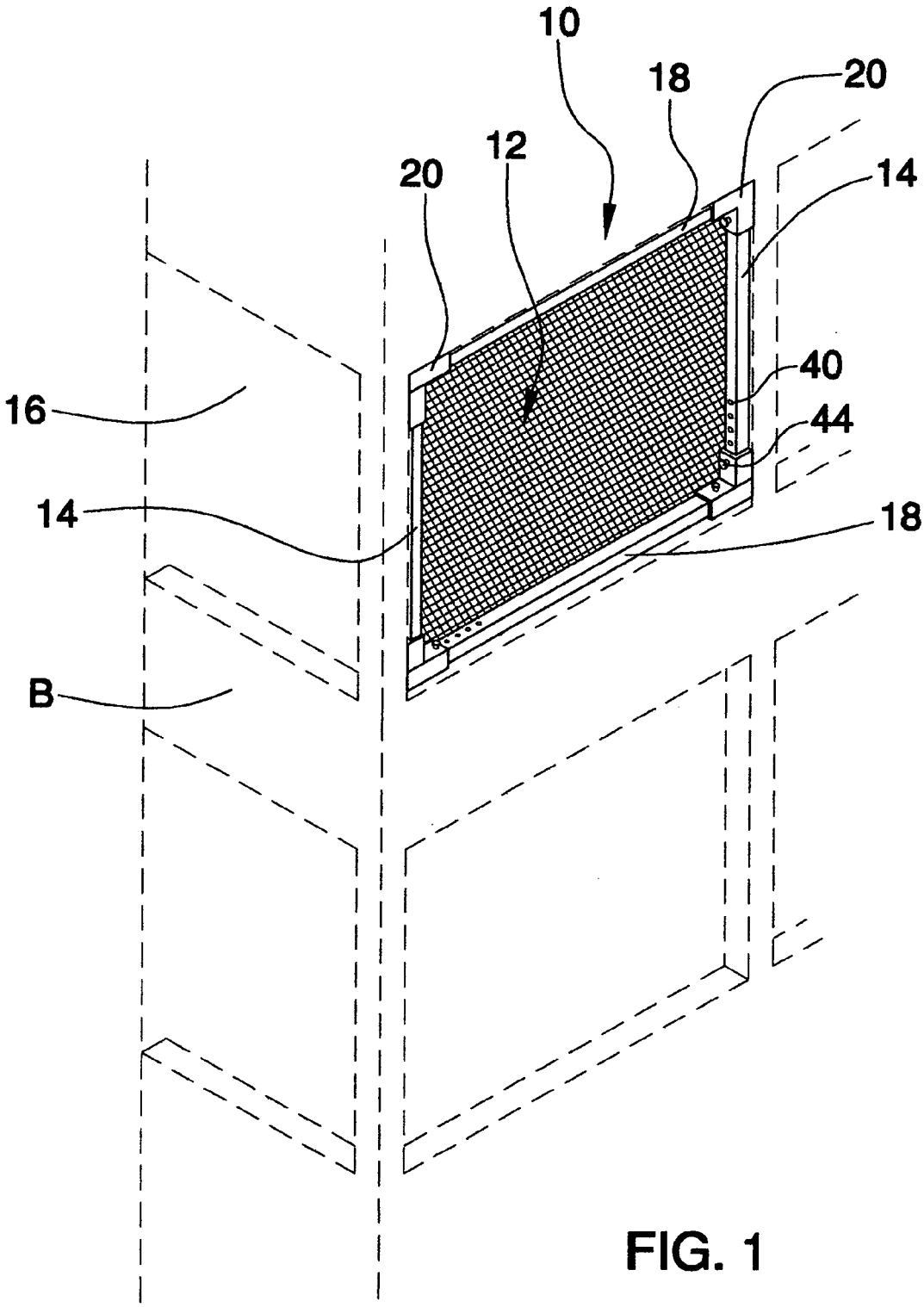
FIG. 1 is a perspective view of the preferred embodiment of the removable and adjustable screen constructed and installed in accordance with the principles of the present invention.

Referring now to the drawings, and particularly to FIGS. 1–4, a preferred embodiment of the removable and adjustable screen of the present invention is shown and generally designated by the reference numeral 10.

In FIG. 1, a new and improved removable and adjustable screen 10 of the present invention for fitting various sized openings is illustrated and will be described. The device 10 of the present invention fits within rectangular upright openings 16 in buildings B and other structures. More particularly, the removable and adjustable screen 10 has a rectangular screen 12 bounded by two mutually parallel stiles 14 and two mutually parallel rails 18 connected by first elbows 20 and second elbows 32. The screen 12 has a mesh material that admits light and air while excluding insects, birds, creatures, and other objects. The screen 12 may be sized to fit a particular area, or the stiles 14, rails 18, first elbows 20 and second elbows 32 may include adjusting means 34. The adjusting means 34 permit adjusting the length of the stiles 14 and the rails 18 to fit an opening 16. With the device 10 installed in an opening 16, the screen 12 is toward the interior of the building and denotes the back of the device 10 while the stiles 14 and the rails 18 are towards the exterior of the building B and denote the front of the device 10.

Figure 2:
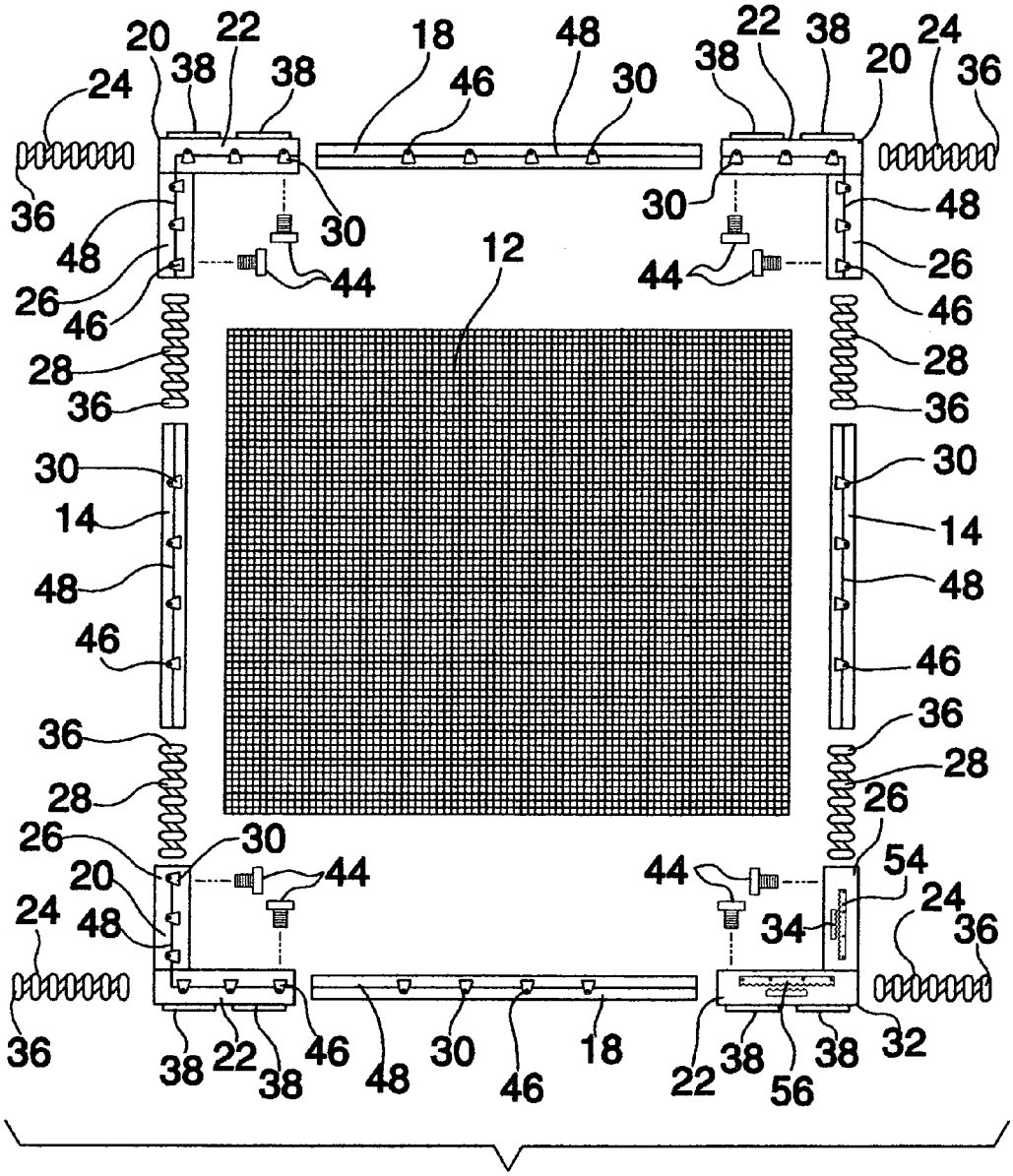
FIG. 2 is an exploded view of the removable and adjustable screen of the present invention.

Turning to FIG. 2, the device 10 is assembled from component parts: first elbows 20, second elbows 32, rails 18, and stiles 14. A first elbow 20 has a hollow first end 22 and a perpendicular hollow second end 26 in an 1, shape. The first end 22 has a cross section on a plane perpendicular to the length of the first end 22 slightly larger than the cross section of a rail 18 on a plane perpendicular to the length of the rail 18. The rail 18 snugly fits into the first end 22. Within the first end 22 opposite of a rail 18, a first spring 24 attaches to the first end 22 and has an opposite free end 36. The free end 36 extends outward from the first end 22. Optionally, thumbscrews 44 that turn through a threaded holes 42 on the first end 22 near the rail 18 and on the interior of the L shape may be included. On the exterior of the L shape opposite the second end 26, the first end 22 has one or more feet 38. In the preferred embodiment, the first end 22 has two rubber feet 38. On a plane between the feet 38 and the thumbscrew 44, the first end 22 has a gripping means 30: two or more clips 46 adjacent to a groove 48 lengthwise upon the first end 22.

The second end 26 has a cross section on a plane perpendicular to the length of the second end 26 slightly larger than the cross section of a stile 14 on a plane perpendicular to the length of the stile 14. The stile 14 snugly fits into the second end 26. Within the second end 26 opposite of a stile 14, a second spring 28 attaches to the first end 22 and has an opposite free end 36. The free end 36 terminates at the stile 14 opposite the joint of the L shape. On the same plane as the first end 22, the second end 26 has two or more clips 46 adjacent to a groove 48 lengthwise upon the second end 26.

Akin to a first elbow 20, a second elbow 32 has a first end 22 with a first spring 24, and a second end 26 with a second spring 28. It may also optionally include thumbscrews 44 that are secured via threaded holes 42. In lieu of the gripping means 30 upon a first elbow 20, a second elbow 32 may have an adjusting means 34 upon the first end 22 and the second end 26, occupying the same plane. The adjusting means 34 is coplanar with the gripping means 30 of the first elbows 20. In the preferred embodiment, two parallel, toothed, opposed plates 54 form the adjusting means 34 upon the first end 22 and the second end 26. The teeth 56 of each plate 54 face each other with a gap between plates 54 sized to admit the screen 12. The longitudinal axis of the plates 54 is collinear with the groove 48 in the stiles 14 and the rails 18. In a first alternative embodiment, the plates 54 attach to the second elbow 32 with screws. In an alternate embodiment, rivets attach the plates 54 to the second elbow 32. In another alternate embodiment, the plates 54 attach to the second elbow 32 by an adhesive.

Next, two mutually parallel rails 18 span between the first ends 22 of the first elbows 20 and the second elbows 32. The rails 18 extend along the width of the screen 12. Upon their exterior, rails 18 have a gripping means 30. In the preferred embodiment, the gripping means 30 is three or more clips 46 adjacent to a groove 48 lengthwise along the rail 18. Optionally, the rails 18 may define a plurality of holes 40 spaced lengthwise. These optional holes 40 cooperate with the thumbscrews 44 in the first ends 22 to removably fix the width of the device 10.

Perpendicular to the rails 18, two mutually parallel stiles 14 span between the second ends 26 of the first elbows 20 and the second elbows 32. The stiles 14 extend along the height of the screen 12. Upon their exterior, stiles 14 have gripping means 30. In the preferred embodiment, the gripping means 30 is three or more clips 46 adjacent to a groove 48 lengthwise along the stile 14. If an adjustable width is desirable, the stiles 14 may define a plurality of holes 40 spaced lengthwise to cooperate with optional thumbscrews 44 in the second ends 26 to removably fix the width of the device 10. As for cross section in the preferred embodiment, the stiles 14, the rails 18, the first ends 22, and the second ends 26 have a square cross section on a plane perpendicular to their respective lengths. In an alternate embodiment, a round cross section may be used for the parts.

Figure 3:
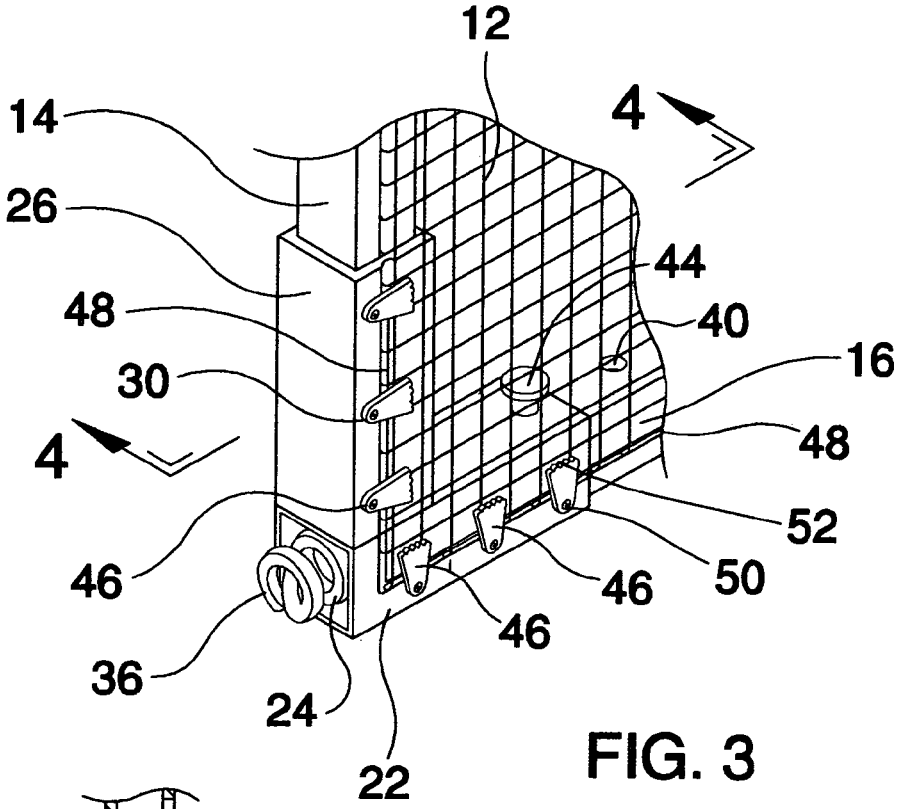
FIG. 3 is a detailed view of the back of an elbow of the removable and adjustable screen of the present invention.

In FIG. 3, the gripping means 30 secures the screen 12 to an elbow upon the back of the device 10. Each end of an elbow has two or more clips 46 that grasp the screen 12. Each clip 46 has a fixed end 50 attached to an end of an elbow 20,32 and a free end 52 slightly wider than the fixed end 50 for grasping the screen 12. The clips 46, on each end of an elbow 20,32, point in the same direction. Cooperating with the clips 46, a centered groove 48 runs the length of each end. The perimeter of the screen 12 folds into the groove 48 upon the ends, the stiles 14, and the rails 18. In the preferred embodiment, the fixed ends 50 of the clips 46 attach to an end by screws.

Figure 4:
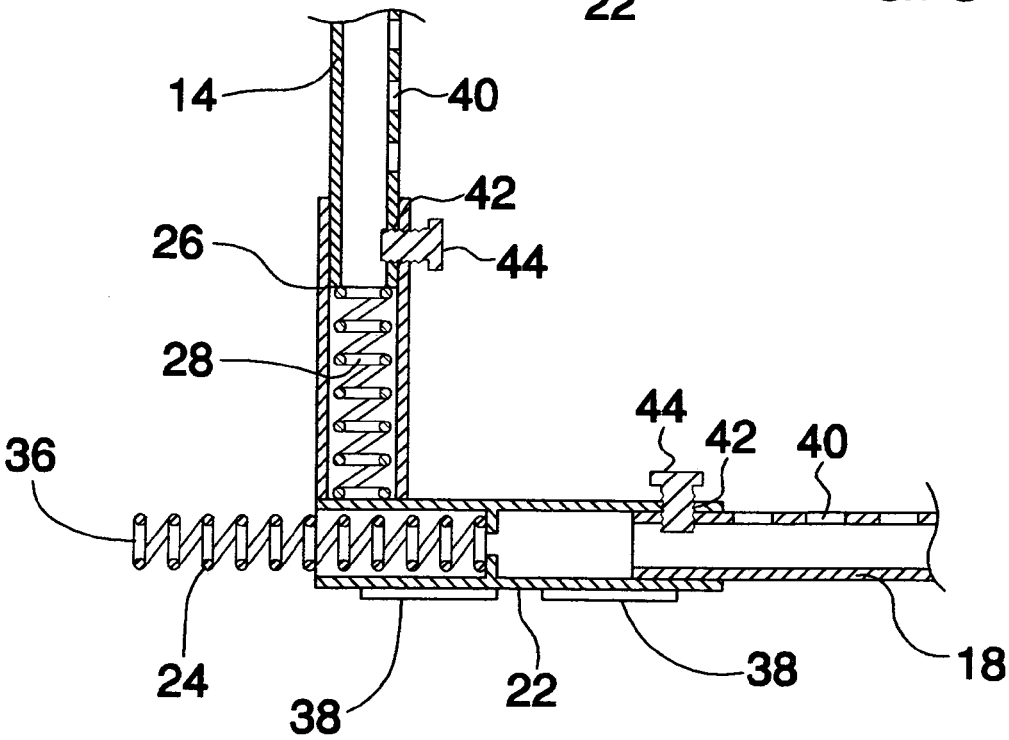
FIG. 4 is a section view of an elbow and contiguous members of the removable and adjustable screen of the present invention.

Then in FIG. 4, the connection of a rail 18, stile 14, and elbow appears in more detail looking to the front of the device 110 away from the screen 12. The free end 36 of the first spring 24 extends from the first end 22 to assist in positioning the device 10 in an opening 16. The first spring 24 attaches to the interior of the first end 22 well before the threaded hole 42 to permit adjusting the rail 18. Opposite the first spring 24, the rail 18 fits into the first end 22 to the desired length. At the desired length, a person turns the thumbscrew 44 into a hole 40 in the rail 18 to fix the rail 18 length. Perpendicular to the first end 22, the free end 36 of the second spring 28 remains within the second end 26 to assist in altering the height of the device 10 to match an opening 16. The second spring 28 attaches to the surface of the first end 22 at the joint of the L shape. Opposite the second spring 28, the stile 14 fits into the second end 26 to the desired length.

In use, it can now be understood that a person measures the dimensions of an opening 16. A person then cuts the rails 18 and the stiles 14 slightly less than the respective width and height of an opening 16. Optionally, after installing the rails 18 in the first ends 22 of the first elbows 20 and one or more second elbows 32, the rails 18 may be secured through the use of optional thumbscrews 44. For a test, a person dry fits the assembled rails 18 and elbows in the width of the opening 16 and alters the rail 18 and elbow connection accordingly. With a fit rail 18, a person then installs the stiles 14 into the second ends 26 of the first elbows 20 and one or more second elbows 32 to complete a rectangle. As a final test, a person then fits the assembled rails 18, stiles 14, and elbows, as a rectangle into the opening 16 and alters the stile 14 and elbow connections accordingly. After removing the device 10 from the opening 16, a person places the screen 12 upon the back of the device 10. A person positions the perimeter of the screen 12 beneath the clips 46 and into the groove 48 along the entire perimeter of the device 10. Next, a person places the device 10 with After installations a person enjoys an insect free opening 16.

While a preferred embodiment of the removable and adjustable screen has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, fiberglass, or a variety of wood may be used instead of the rails, stiles, and elbows described. Also, the screen arm may be made of aluminum, steel, fiberglass, plastic, or similar mesh material. Although fitting various sized openings has been described, it should be appreciated that the removable and adjustable screen herein described is also suitable for dividing a room. Furthermore, a wide variety of cross sections may be used instead of the square cross section described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A removable device to exclude insects and creatures, comprising:

a screen, generally rectangular in shape having a width and a height;

two stiles, mutually parallel, rigid, and located upon the perimeter of said screen whereby said stiles extend along said height of said screen upon installation of said device in an opening, and of sufficient length to span the height of said opening;

two rails, mutually parallel, rigid, perpendicular to said stiles, and located upon the perimeter of said screen whereby said rails extend along said width of said screen upon installation of said device in said opening, and of sufficient length to span the width of said opening;

two or more first elbows having a hollow first end to receive said rail and a first spring within said first end, a hollow second end perpendicular to said first end to receive said stile and a second spring within said second end; and, one or more second elbows having a hollow first end to receive said rail and a first spring within said first end, a hollow second end perpendicular to said first end to receive said stile and a second spring within said second end;

whereby, said stiles and said rails connect to said first elbows and said second elbows around the perimeter of said screen.

2. The removable device to exclude insects and creatures of claim 1 wherein said first spring attaches to said first end of said first elbow or said second elbow and has a free end opposite the attachment of said first spring extending beyond said first end that positions said device within said opening.

3. The removable device to exclude insects and creatures of claim 1 wherein said second spring attaches to said second end of said first elbow or said second elbow and has a free end within said second end that extends said device collinear with said stiles to span said opening.

4. The removable device to exclude insects and creatures of claim 1 further comprising said first end of said first elbows and said first end of said second elbows having one or more feet parallel to said rails, on the exterior of said first end opposite said second end.

5. The removable device to exclude insects and creatures of claim 4 wherein said feet are rubber.

6. The removable device to exclude insects and creatures of claim 1 wherein said first ends have a cross-section on a plane normal to the longitudinal axis of said rail that snugly surrounds the cross-section of said rail on a plane normal to the longitudinal axis of said rail, and said second ends have a cross-section on a plane normal to the longitudinal axis of said stile that snugly surrounds the cross-section of said stile on a plane normal to the longitudinal axis of said stile.

7. The removable device to exclude insects and creatures of claim 6 wherein said cross-section is square.

8. The removable device to exclude insects and creatures of claim 1 wherein said screen is a mesh material selected from the group consisting of metal, plastic, fiberglass, and nylon.

9. A removable device to exclude insects and creatures, comprising a screen, generally rectangular in shape having a width and a height;

two stiles, mutually parallel, rigid, and located upon the perimeter of said screen whereby said stiles extend along said height of said screen upon installation of said device in an opening, and of sufficient length to span the height of said opening;

two rails, mutually parallel, rigid, perpendicular to said stiles, and located upon the perimeter of said screen whereby said rails extend along said width of said screen upon installation of said device in said opening, and of sufficient length to span the width of said opening;

two or more first elbows having a hollow first end to receive said rail and a first spring within said first end, a hollow second end perpendicular to said first end to receive said stile and a second spring within said second end, and gripping means upon said first end coplanar with said second end; and, one or more second elbows having a hollow first end to receive said rail and a first spring within said first end, a hollow second end perpendicular to said first end to receive said stile and a second spring within said second end, and adjusting means upon said first end coplanar with said second end;

whereby, said stiles and said rails connect to said first elbows and said second elbows around the perimeter of said screen with said gripping means coplanar with said adjusting means.

10. The removable device to exclude insects and creatures of claim 9 further comprising, said gripping means having three or more coplanar clips;

said stiles having a centered longitudinal groove;

said rails having a centered longitudinal groove;

said first ends having a centered longitudinal groove;

said second ends having a centered longitudinal groove;

whereby, said longitudinal grooves and said clips are coplanar and the perimeter of said screens is inserted into said grooves.

11. The removable device to exclude insects and creatures of claim 10 wherein said clips have a generally trapezoidal shape, a fixed end and an opposite free end, and said free end extends over said screen.

12. The removable device to exclude insects and creatures of claim 9 further comprising, said adjusting means having two opposed plates;

said plates having a plurality of teeth, at least partially, along the perimeter of said plate;

and said teeth of said plates face each other;

whereby, said screen is held in place between said opposed plates.

13. The removable device to exclude insects and creatures of claim 12 wherein said plurality of teeth extend upon one edge of said plate parallel with the longitudinal axis of said plate.

* * * * *